US005870906A

United States Patent [19]

Denisar

[11] Patent Number: 5,870,906

[45] Date of Patent: Feb. 16, 1999

[54] AUTOMATIC DISPENSING DEVICE

[76] Inventor: Richard A. Denisar, 20 Dans Rd., Browns Mills, N.J. 08015

[21] Appl. No.: 626,843

[22] Filed: Apr. 3, 1996

[51] Int. Cl.[6] ..... D06F 39/02

[52] U.S. Cl. ..... 68/17 R; 68/207; 134/93; 137/268; 222/651; 222/308

[58] Field of Search ..... 68/17 R, 207, 68/12.18; 222/651, 134, 434, 438, 308; 134/100.1, 93; 137/268

[56] References Cited

U.S. PATENT DOCUMENTS

| | | | |
|---|---|---|---|
| 1,090,764 | 3/1914 | Thomas | 222/308 |
| 1,940,549 | 12/1933 | Jones | 68/17 R |
| 2,122,216 | 6/1938 | Seawell | 222/308 |
| 2,254,269 | 9/1941 | Clark et al. | 222/308 |
| 2,410,873 | 11/1946 | Gayring | 68/17 R |
| 2,636,503 | 4/1953 | Hilliker | 134/93 |
| 2,762,527 | 9/1956 | Manley | 68/17 R |
| 2,779,502 | 1/1957 | Ackerman, Jr. | 222/308 |
| 2,899,815 | 8/1959 | Hetrick | 68/17 R |
| 3,044,285 | 7/1962 | Koplin | 68/12.18 |
| 3,058,330 | 10/1962 | Grantham | 68/17 R |
| 3,120,329 | 2/1964 | Noakes | 222/651 |
| 3,336,767 | 8/1967 | Mackenzie et al. | 68/207 |
| 3,402,853 | 9/1968 | Perl | 222/651 |
| 3,771,333 | 11/1973 | Jurjans | 68/12.18 |
| 3,804,297 | 4/1974 | Jurjans | 68/12.18 |
| 3,891,123 | 6/1975 | Blackburn | 68/207 |
| 4,630,634 | 12/1986 | Sasaki et al. | 137/268 |
| 4,750,512 | 6/1988 | Craig | 123/268 |
| 4,781,308 | 11/1988 | Yamano | 222/308 |
| 4,981,024 | 1/1991 | Beldham | 68/207 |
| 5,435,157 | 7/1995 | Laughlin | 68/17 R |

FOREIGN PATENT DOCUMENTS

| | | | |
|---|---|---|---|
| 1913868 | 12/1969 | Germany | 68/17 R |
| 3835719 | 4/1990 | Germany | 222/651 |

OTHER PUBLICATIONS

WO 94/15516, Jul. 1994.

*Primary Examiner*—Frankie L. Stinson
*Attorney, Agent, or Firm*—Synnestvedt & Lechner

[57] ABSTRACT

The present invention relates to gravity based dispensers for washing machines that incorporate at least one storage reservoir and at least one dispersement chamber, wherein the dispersement chamber is adjusted by a user to regulate the amount of a liquid or granular material that is dispensed by the device. The device is controllable to allow a predetermined amount of the stored material to be dispensed into the dispersement chamber. The material is then flushed or dispersed from the chamber by the introduction of a fluid that is under pressure into the dispersement chamber.

10 Claims, 7 Drawing Sheets

AUTOMATIC DISPENSING DEVICE

TECHNICAL FIELD

The present invention relates to an automatic dispenser designed to be used with washing machines, capable of holding washing chemicals in reserve (fluid or granular), and then dispensing a predetermined amount at the appropriate times during each wash cycle. More particularly, the present invention supplies separately stored chemicals, via a gravity feed through a solenoid actuated valve system, to separate adjustable volume mixing chambers. The mixing chambers are then flushed with water and dispersed into the washing machine at the appropriate times during the washing process.

BACKGROUND OF THE INVENTION

Prior art devices exist that attempt to introduce cleaning agents into washing machines in many different ways. U.S. Pat. No. 4,700,554 and U.S. Pat. No. 5,253,494, each require the user to physically place agents in reservoirs each time a wash load is introduced.

U.S. Pat. No. 5,063,757 and U.S. Pat. No. 5,413,259, each teach methods for introducing only granular chemicals. U.S. Pat. No. 5,267,676 teaches a method for introducing only fluid.

U.S. Pat. No. 5,392,618 and U.S. Pat. No. 5,390,385 each teach a method to introduce the required agents, but they require the use of pumps and sophisticated electronic components.

U.S. Pat. No. 5,425,404 teaches a gravity feed fluid dispensing system which includes a bottle that is engageable with a dispenser assembly. The dispenser assembly includes a diluting chamber which receives diluting fluid. When the bottle is engaged with the dispenser assembly, a valve is actuated in the mouth of the bottle which opens to allow the fluid in the bottle to gravity feed into the dispenser assembly and into the diluting chamber at a predetermined steady rate. A diluting valve controls the flow of diluting fluid to the diluting chamber by means of a switch that shifts the diluting valve to the open position in response to the bottle being engaged with the dispenser assembly. Thus, the invention of the '404 patent can only allow a steady, predetermined flow of liquid to be constantly dispensed and mixed with diluting fluid, and the dispensing continues until the bottle is empty.

The present invention teaches a simple, versatile, low cost method of dispensing cleaning agents into a washing machine in a simple manner that no prior art has so fully accomplished. The present invention eliminates the need to manually put cleaning agents into the wash before each cycle by supplying a ready reserve of agents that are automatically dispensed, thus reducing the workload of the user. The present invention allows the introduction of either fluid or granular materials in a simple and efficient manner.

SUMMARY OF THE INVENTION

It is the purpose of the present invention to eliminate the need for the user of a washing machine to place cleaning agents in the washing machine or dispenser before each use. This is accomplished by providing a device that dispenses materials into a washing machine, said washing machine including a wash tub and including a water supply, said device comprising reservoir means for storing quantities of said materials to be dispensed and for dispensing said materials utilizing the force of gravity, said reservoir means being of a size sufficient to hold enough of said materials for more than one washload; mixing chamber means for containing a predetermined amount of said material dispensed from said reservoir means and for mixing said predetermined amount of said dispensed material with wash water or rinse water; and routing means for routing materials from said reservoir means to said mixing chamber means and for routing wash water mixed with said materials from said mixing chamber means to the wash tub of said washing machine. This invention enables the user of a washing machine to periodically visually monitor the cleaning agent reserve levels, to load articles to be washed into the washer, to set which agents should be added to the wash, and then to turn it on. The cleaning agents are automatically dispensed at the proper times. The present invention combines separate cleaning agent storage reservoirs, solenoid operated valves, and adjustable volume mixing chambers that, when urged to do so by a user, or by an electrical charge supplied by a washing machine, will dispense a fluid or granular material into the washing machine.

The present invention includes a storage reservoir, or several storage reservoirs, that a user periodically fills with large quantities of washing or rinsing agents. These storage containers can be built in to a washing machine, or mounted near a washing machine in such a way that the contents could then gravity feed into a valve assembly located on the lower rear end of the storage container(s).

The valve assembly contains several passage ways which can be selectively isolated from or connected to each other, by means of outlet and inlet ports. The valve assembly is controlled by switching means, such as an electrical solenoid, which, when actuated by switching elements already contained within the washing machine, will move a valve seal plunger assembly against the pressure of a spring, thus changing position of plunger seals within the passage ways. By this action, inlet and outlet ports within the passage ways are opened or closed.

With the valve assembly in a neutral state and the plunger spring holding the valve plunger down, the valve assembly allows the contents of a storage container to gravity feed into a lower mixing chamber where it is held while awaiting a flushing cycle. The mixing chamber is selectively adjustable in size, allowing a user to regulate the amount of agent to be dispensed. The gravity feed action is enhanced by use of a vent tube which contains an anti-overflow port that discharges back into the storage container. While the valve assembly is in the neutral position and the mixing chamber is filling with either a granular or fluid agent, the remaining passageways are sealed, thus containing the agent within the mixing chamber.

Once the material is in the mixing chamber, at the appropriate time the switching means is put into an "activated" state to reposition the plunger valve seal assembly, thus closing off the ports that allowed the agents to enter the mixing chamber, and opening ports which are connected via a conduit to the water supply on the washing machine, and opening exit ports of the mixing chamber. The water is then supplied to the mixing chamber, and the water pressure flushes the material out of the mixing chamber exit ports, via a conduit, back to the washing machine where it enters the wash tub.

In the preferred embodiment the present invention is built into a washing machine. However, it is also possible to use the present invention as an accessory to a washing machine, or group of machines. By adding a coin operated electrical switch the present invention might be used in Laundromats, where the consumer would have the option of adding a coin and having detergent automatically dispensed into the machine, or the consumer could choose not to put in a coin and could add their own detergent.

The methods structures, and devices of the present invention will become more clear from the following drawings, and descriptions of embodiments.

BRIEF DESCRIPTION OF THE DRAWINGS

The accompanying drawings show the present invention in certain forms, but the invention should not be limited to only these forms shown. It should be recognized that the present invention can be used in the forms shown for the purpose of dispensing washing agents into a washing machine but that the present invention is not limited to this function. The present invention can be used in many applications that require granular or fluid materials to be dispensed for various reasons.

FIG. 9 shows that the hot (HS) and cold (CS) supply lines are hooked up directly to the washing machine. The dashed line leading from the mixing valve would normally lead directly to the wash tub, but with the use of the present invention, it first connects to the present invention as a supply line to ports 3, 23, and 33. Line 38H acts as a return line to the wash tub, after being interconnected with ports 7H, 5H, 27H, 25H, 37H, and 35H.

DETAILED DESCRIPTION OF THE PREFERRED EMBODIMENT

Figure 1:
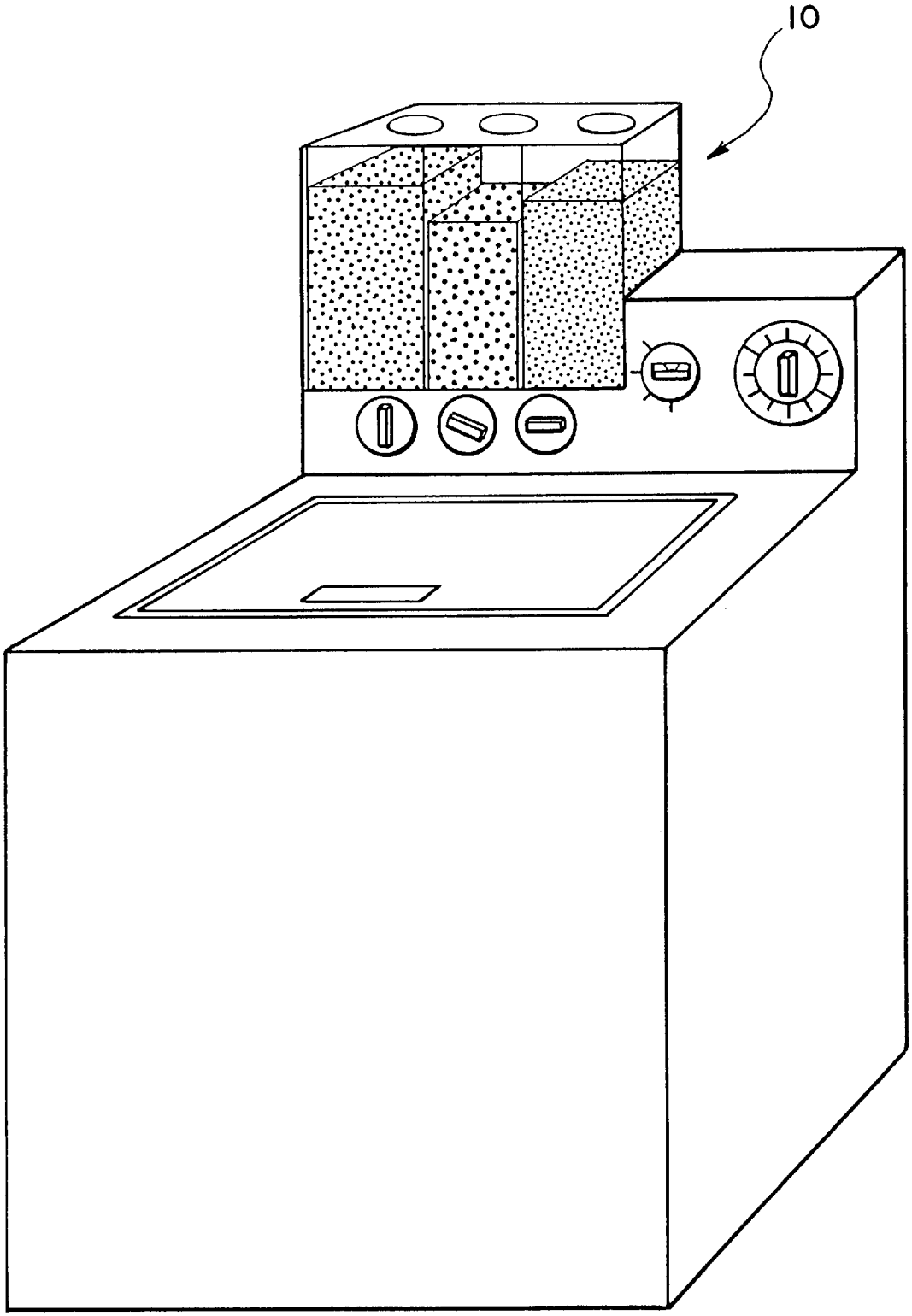
FIG. 1 is a perspective view of the present invention incorporated directly into a common present day washing machine.
Figure 2:
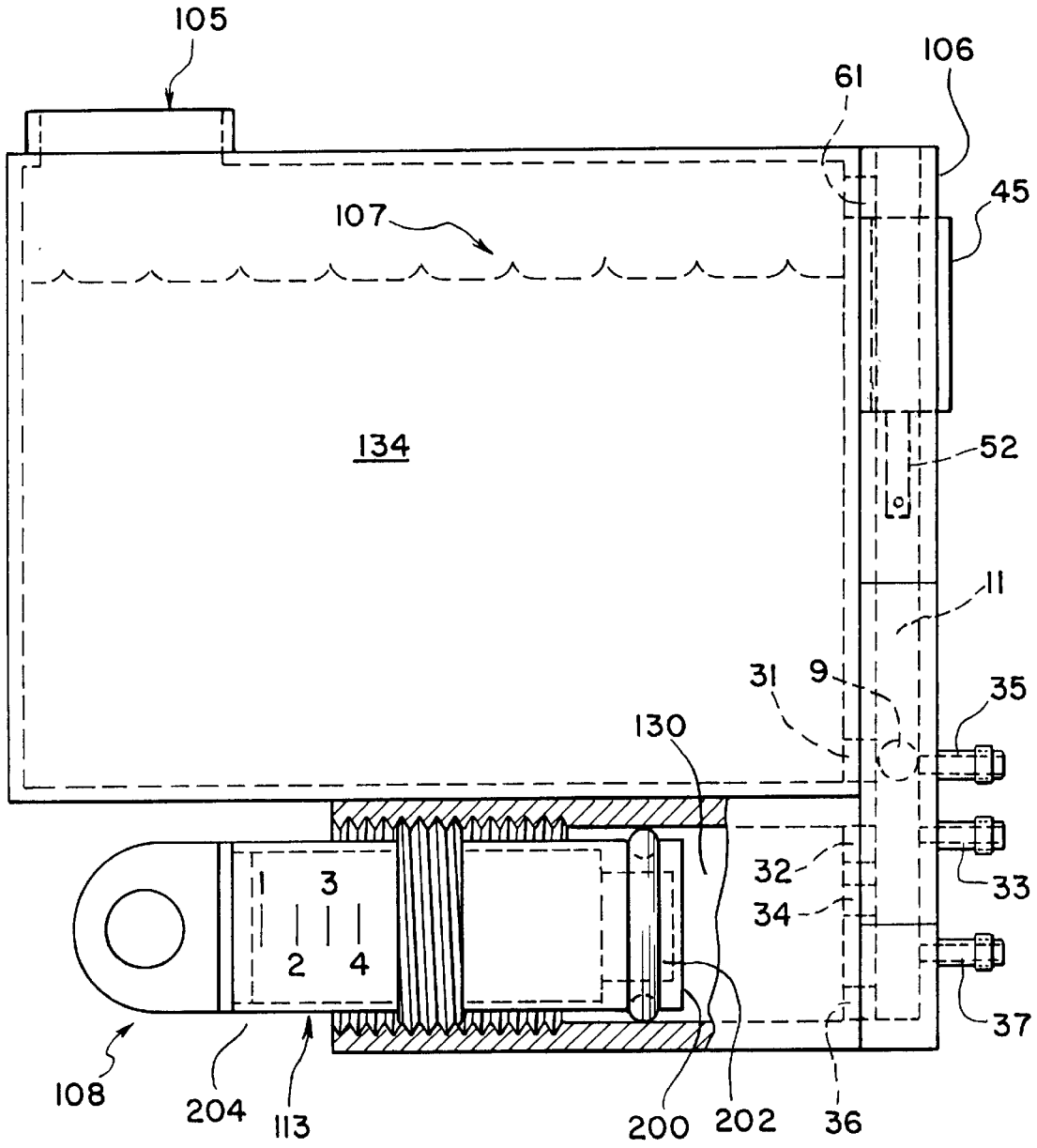
FIG. 2 is a side cut-away view showing the reservoir housing, the valve assembly passageways at the rear, and the mixing chamber at the bottom.
Figure 3:
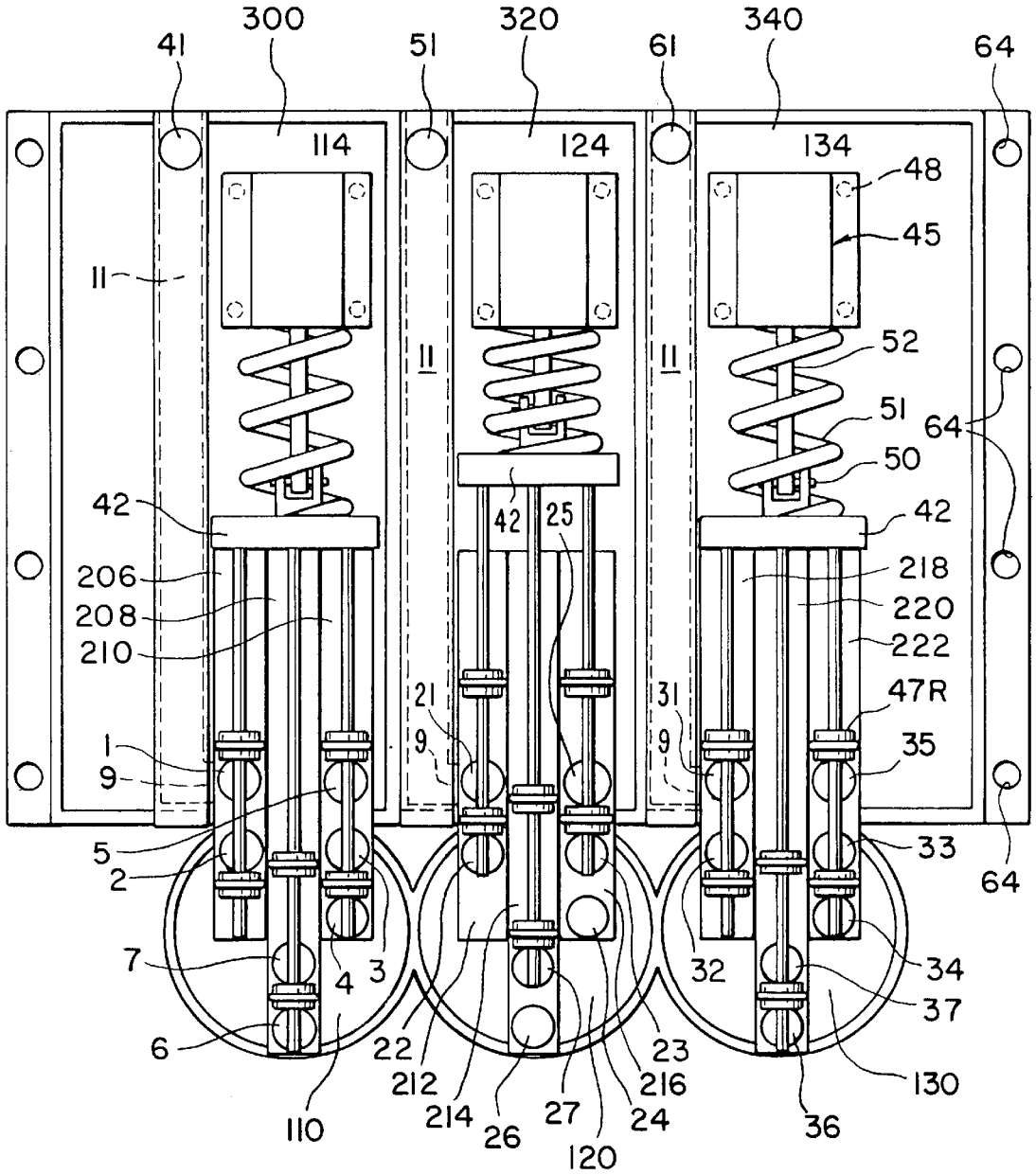
FIG. 3 is a front cut-away view of the preferred embodiment of the present invention showing the locations of the three valve assemblies, solenoids, passageways, and ports in relationship to the position of the three storage reservoirs, and the three mixing chambers. The left valve assembly is shown in an "activated" position, with the remaining two valve assemblies in a "neutral" position.
Figure 4:
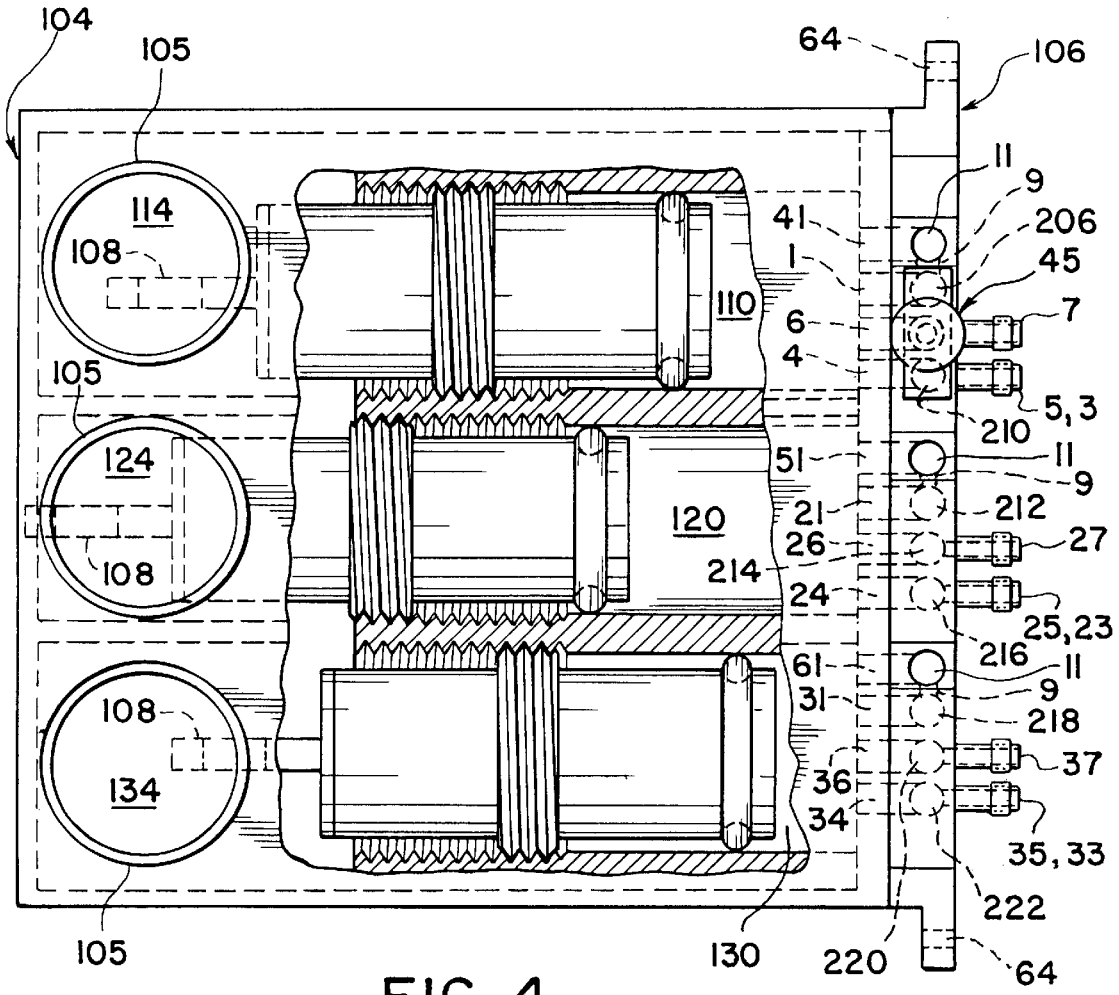
FIG. 4 is a top cut-away view of the present invention showing the three volume regulators in different positions, thus each being able to hold a different volume of agent in each of the mixing chambers. This view also shows a top view looking down the valve passageways, inlet, and exit ports, and that these passageways and ports are an integral part of the single piece rear plate, or cover.

FIG. 1 is a perspective view of the automatic dispensing unit 10 of the present invention, incorporated directly into a standard washing machine unit. FIG. 2 is a side cut-away view of the automatic dispensing unit 10, FIG. 3 is a front cut-away view of automatic dispensing unit 10, and FIG. 4 is a top cut-away view of automatic dispensing unit 10. In FIG. 2, reservoir housing 134 can be seen, which is typical of a the three reservoirs 114, 124, and 134, comprising a reservoir means, visible in FIG. 4. Reservoir 134 is a container that is preferably manufactured from clear plastic and holds a cleaning agent such as detergent, bleach, or fabric softener. The reservoirs are attached to a routing means comprising back plate 106, discussed in more detail below. Located on top of each reservoir is an opening 105 through which the cleaning agents can be poured to fill the reservoirs. Typically a user would fill the reservoir to approximately the level shown by line 107. A "maximum fill" line can be marked on the front of each reservoir and/or each reservoir can be labeled with an indication of the type of agent to be placed in it (e.g., detergent, bleach, or fabric softener).

Beneath reservoir 134 is a mixing chamber 130; similarly, beneath reservoir 124 is a mixing chamber 120, and beneath reservoir 114 is a mixing chamber 110. The three mixing chambers comprise mixing chamber means and need not be limited to exactly three mixing chambers; lesser or fewer mixing chambers can be used, as long as there are an equal number of reservoirs so that each reservoir has a mixing chamber associated with it. Each reservoir/mixing chamber combination is identical and, therefore, the description below of the details of reservoir/mixing chamber combination 134/130 also applies to the other two.

Figure 5:
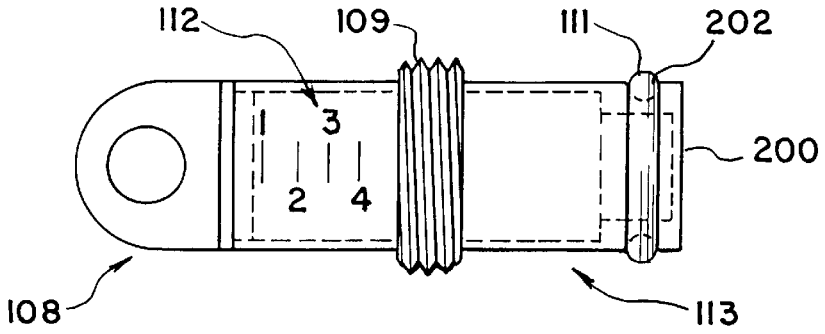
FIG. 5 shows the volume regulator plug, with the O-ring seal on one end and the hand adjustment knob at the other end.

Mixing chamber 130 is cylindrical and has a volume regulator plug 113 that is threaded into the front end of mixing chamber 130 as shown in FIG. 2. The rear end of mixing chamber 130 is sealed by back plate 106 which is fixedly attached or bonded to mixing chamber 130. Volume regulator plug 113 can be turned in or out of mixing chamber 130 to increase or decrease the functional size of mixing chamber 130. Volume regulator plug 113 is shown separately in FIG. 5.

The main body of volume regulator plug 113 can be injection molded. The main body is a hollow tube with the back end 200 closed. Half way up the length of the main body is a threaded portion 109. Near the closed back end 200 is a grooved portion 202 that extends around the outer perimeter of the cylinder; the grooved portion 202 accepts O-ring 111 which provides a seal within the mixing chamber 130, thereby preventing the contents of the mixing chamber from passing the O-ring. Graduation marks 112 are marked towards the front end 204 of the cylinder to help the user identify the proper position to place the volume regulator plug 113, depending upon the type of agent intended to be dispersed. On the front end 204 of volume regulator plug 113 is a knob or handle 108 which can be turned by the user, thus moving the volume regulator plug 113 in or out. The knob or handle 108 can be a molded part which is fixedly attached to the front end 204 of volume regulator plug 113, or the entire volume regulator plug can be a unitary piece.

In the preferred embodiment, the three reservoirs 114, 124, and 134, and the three mixing chambers 110, 120, and 130 are molded as one piece, with an open back side, and made with clear plastic. Back plate 106 is molded separately and includes valve passageways and inlet and exit ports (all described more fully below) molded as a single unit. It is contemplated that a user may wish to select, one, two, or all three reservoirs for use during any one wash load. Further, although the preferred embodiment discloses a three reservoir unit, any number of reservoirs could be utilized.

Back plate 106 includes flanges with holes 64 (see FIG. 4) to enable mounting of the invention to a washer or wall. The back plate 106 can be glued, screwed, or otherwise fastened to the reservoirs and mixing chambers, thus "closing" the open back of the reservoirs 114, 124, and 134, thereby sealing them and making them capable of containing fluids or granular materials.

The flow of the materials from the reservoirs to the mixing chambers is now described. Back plate 106 includes a series of valve passageways 206, 208, 210, 212, 214, 216, 218, 220, and 222 (see FIG. 3) that provide paths for the flow of cleaning agents and/or water. Referring to FIG. 2, in the lower rear corner of reservoir 134 is exit port 31 formed in back plate 106. Exit port 31 allows the contents of reservoir 134 to enter valve passageway 218. Valve passageway 218 also includes inlet port 32, which is beneath exit 31. Inlet port 32 provides an opening into mixing chamber 130. Thus, if unimpeded, material from reservoir 134 will gravity feed through exit port 31, into valve passageway 218, and into mixing chamber 130 via inlet port 32.

Port 9 is a small opening that provides a venting path to adjacent venting tube 11. Venting tube 11 goes all the way to the top of the back of reservoir 134. Near the top of venting tube 11, and above the fill line 107, is an overflow port 41 leading back into the reservoir 134. Overflow 41 allows any fluid that might travel up venting tube 11 during venting to pour back into reservoir 134, and prevent said fluid from spilling out the top of venting tube 11.

Thus it should now be apparent that the basic invention comprises three separate storage reservoirs 114, 124, and 134, each with an associated mixing chamber 110, 120, and 130, respectively, located beneath each reservoir. The capacity of each mixing chamber 110, 120, and 130 is adjustable by the turning of a volume regulator plug 113 in or out. Passageways and ports that are molded into back plate 106 connect the reservoirs to the respective mixing chambers via ports in the reservoirs and mixing chambers.

To provide a thorough understanding of the present invention, valve assemblies are now described in detail, said valve assemblies controlling the operation of the dispensing unit. Referring to FIG. 3, three separate valve assemblies 300, 320, and 340 are shown; since the operation of each is identical, the discussion herein will be limited to the operation of valve assembly 340, which is associated with reservoir 134/mixing chamber 130. In FIG. 3, valve assembly 340 is shown in the neutral, or "fill" position. The valve assembly 340 is shown separately, and in more detail, in FIG. 6. Valve assembly 340 is connected to reservoir 134 and mixing chamber 130. As previously described, exit port 31 allows the contents of reservoir 134 to enter valve passageway 218 and, due to the effect of gravity, feed down valve passageway 218 and through inlet port 32 into mixing chamber 130, where it remains stored until needed for the wash or rinse cycle.

Figure 6:
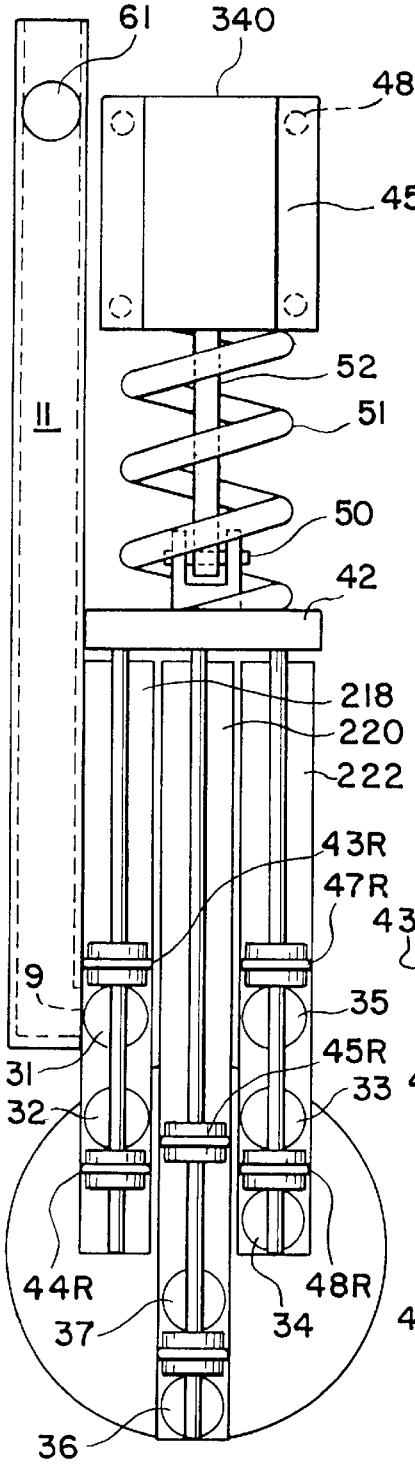
FIG. 6 is a front cut-away view of a single valve assembly of the present invention, showing only certain items that pertain to the understanding of the operation of the valve assembly. The valve assembly is shown in a neutral position, or fill position.
Figure 7:
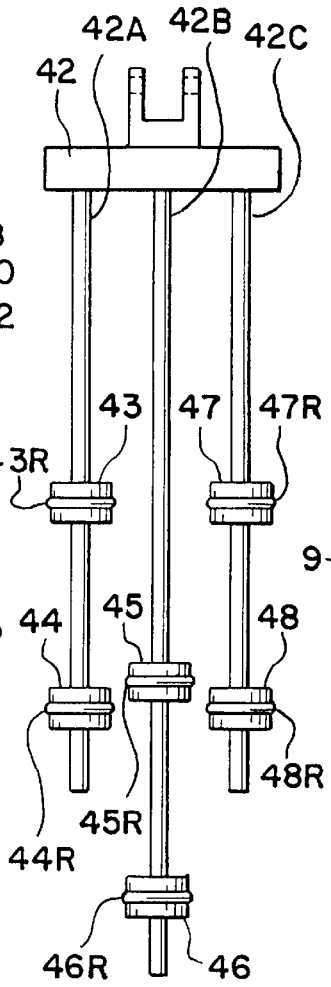
FIG. 7 shows only the valve seal plunger, common to all the valve assemblies.

FIG. 7 shows valve plunger assembly 42 of valve assembly 340 separately; each valve assembly (300, 320, and 340) has a valve plunger assembly 42 and all three valve assemblies, and the valve plunger assemblies thereof, are identical. Valve plunger assembly 42 is located within the valve passageways 218, 220, and 222 located in back plate 106. The top of plunger assembly 42 has a connecting means, such as a hole and pin 50 (see FIG. 6), which connects the valve plunger assembly 42 to an arm 52 of a commercially available electrical solenoid 45. The solenoid 45 is attached to back plate 106. The complete valve plunger assembly 42 can be a unitary molded part, with three lower fingers 42A, 42B, and 42C that each have two widened areas (43 and 44, 45 and 46, and 47 and 48, as shown in FIG. 7) that fit the bore of the valve passageways 218, 220, and 222. Each of the widened areas 43, 44, 45, 46, 47, and 48 include grooves that accept O-rings 43R, 44R, 45R, 46R, 47R, and 48R, respectively.

Viewing the plunger in the neutral position as shown in FIG. 6, O-ring 43R is above exit port 31, and O-ring 44R is below inlet port 32; this creates an open path between exit ports 31 and inlet port 32, thereby interconnecting the reservoir 134 and the mixing chamber 130. The O-ring 43R prevents any of the material from reservoir 134 from passing it. Port 9, which is located at the bottom of vent tube 11, also provides and opening into the open path formed between the two O-rings 43R and 44R. In this neutral position, exit port 31 allows the contents of the reservoir 134 to enter the path created between the two O-rings 43R and 44R and gravity feed down and through inlet port 32 and into the mixing chamber 130, as previously described.

Ports 36 and 37 are formed in valve passageway 220 as shown in FIG. 6. Ports 33, 34, and 35 are formed in passageway 222 as shown in FIG. 6. Port 9 provides a path to vent tube 11 which vents out the top thereof. With the valve assembly in the neutral position, ports 34 and 36 are also open to the mixing chamber 130; however, the materials that are gravity feeding into chamber 130 are blocked from going anywhere by the O-rings 48R and 46R, respectively, located directly above them.

Port 36 forms an opening that connects the mixing chamber 130 to valve passageway 220 that is adjacent to, but completely separate from valve passageway 218. Also formed in valve passageway 220 is port 37, which connects valve passageway 220 to an outlet line 37H shown by a solid line in FIG. 9.

Port 34 is an opening that connects mixing chamber 130 to valve passageway 222 that is also adjacent to, but completely separate from, valve passageways 218 and 220. Also formed in valve passageway 222 is port 33 and port 35. Port 33 is an opening that passes from the backside of passageway 222 to a standard coupling formed on the back of back plate 106, to which water inlet line 33 is attached, thus allowing the entry of water from the washing machine mixing valve to valve passageway 222, as shown in FIG. 9.

To understand the operation of the present invention it is necessary to briefly discuss the operation of a standard washing machine. Present day washers have an electrically controlled on/off mixing valve to which hot and cold water supply lines are connected. This valve is controlled by a selector module located on the washing machine which, on most modern machines, is an electronic switching device. A positive water pressure is supplied to the mixing valve via the supply lines, and unless the washing machine is turned on the mixing valve remains closed. When the washer is turned on an electrical signal causes the mixing valve to open and allows water (hot, warm, or cold as selected by the user) to fill the wash tub of the washing machine.

As noted above, the sequencing of the opening and closing of the various ports is controlled by the standard controls on a standard washing machine, i.e., the opening of the valves that allow water to enter the mixing chamber is controlled by the same controller that already controls the on/off mixing valve. However, it is preferable to include a standard timing means to allow a short delay of, for example, 30 seconds between the time that the on/off mixing valve is opened and the time that the valve system of the present invention allows the water to enter the mixing chamber, and also to allow the valve system of the present invention to remain open for an additional period, for example, 30 seconds, after the on/off mixing valve of the machine cuts off the water coming into the machine. This second delay serves to allow the mixing chamber to be drained before the valves of the present invention move back to the neutral position. This delay could be accomplished by any known means, including the use of separate time-delayed switches or the inclusion of additional cams to the cam switch that is used to control the functions of a standard washing machine.

Figure 9:
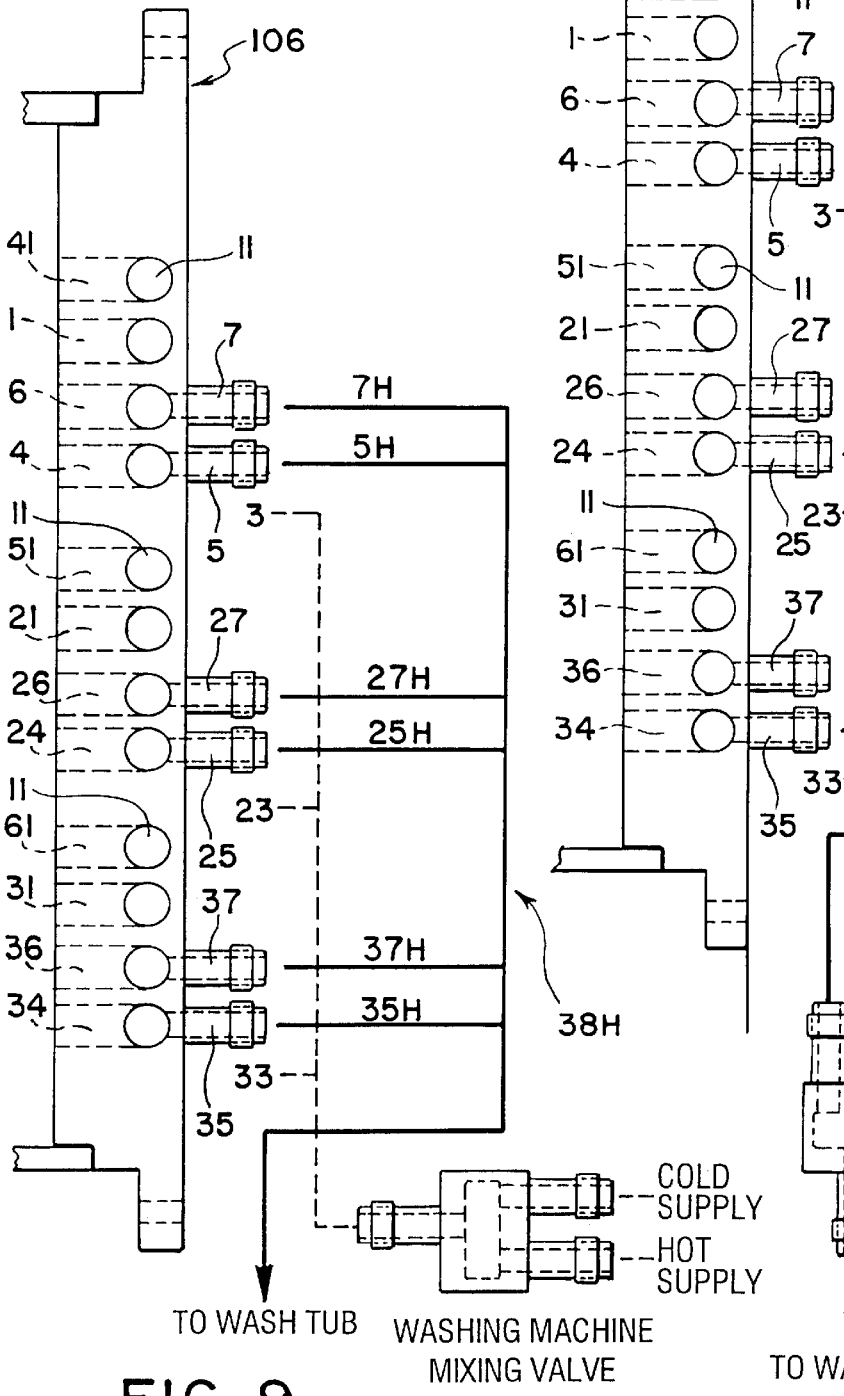
FIG. 9 is a flow chart of the conduit or hose connections that attach to the various ports of the present invention in an embodiment when it is built directly into a washing machine, as shown in FIG. 1.
Figure 10:
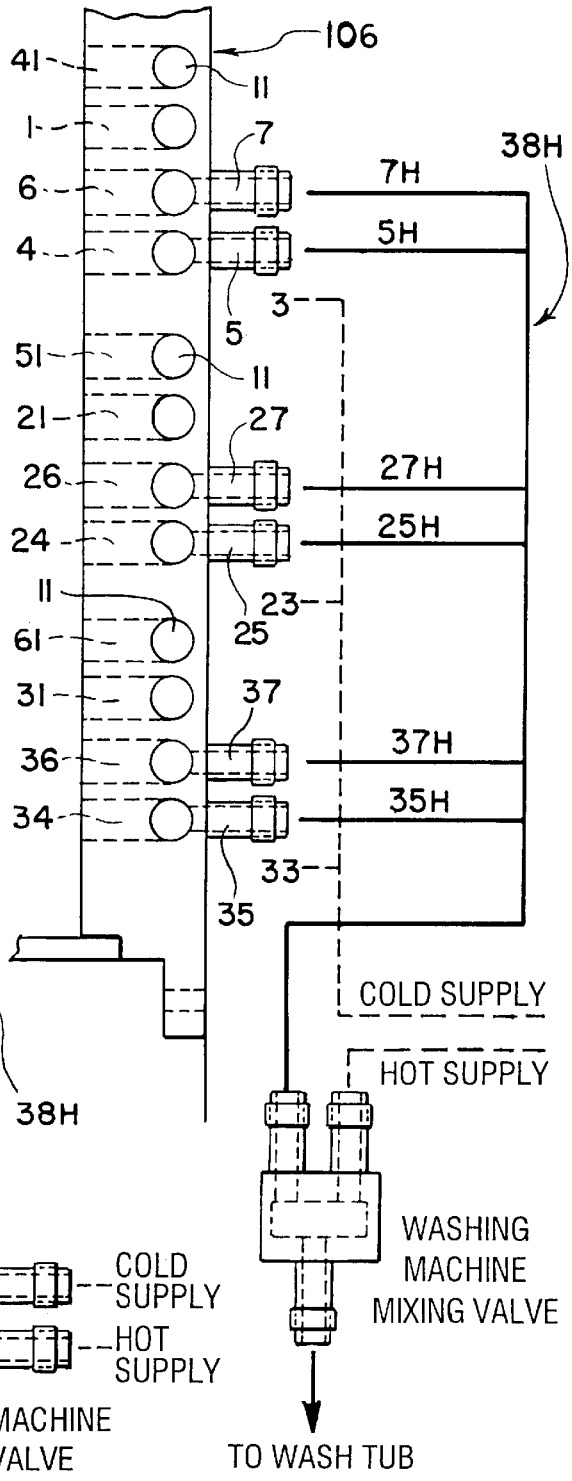
FIG. 10 is a flow chart of the conduit or hose connections that attach to the various ports of the present invent when it is used as an accessory to an existing washing machine as shown in FIG. 11. In this form a user does not have to connect anything to the washing machine other than the supply lines, which are connected to the hose attachment locations found on all washing machines. In this form the present invention could be easily be marketed as an easily attached add-on product. This specific flowchart limits the user to only hot or cold water being provided to the present invention, and somewhat limits the overall use, but still is capable of reducing the users workload by eliminating the need of the user to place agents manually into a washing machine at each wash.
Figure 11:
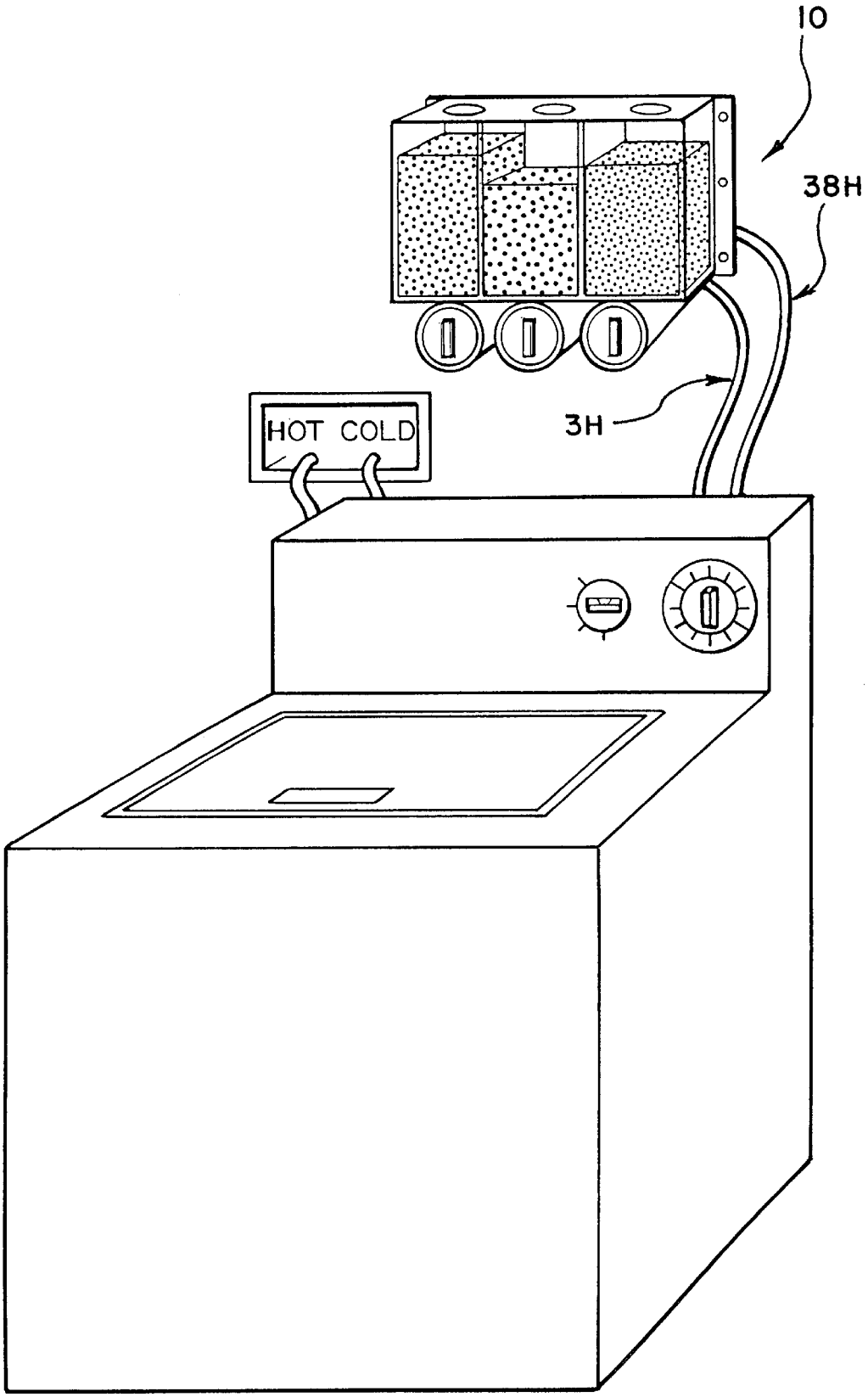
FIG. 11 is a perspective view of what the present invention might look like if it were to be used as an accessory to a present day washing machine.

The present invention is installed as shown in FIG. 9 by connecting the outlet of the washing machine mixing valve to port 33 (and ports 3 and 23 if more than one dispenser is used) rather than to the wash basin as is done with present day machines. A connection is also made linking line 38H, which goes to the wash tub, with ports 35 and 37 so that liquid leaving the device of the present invention via ports 35 and 37 will be directed to the wash tub. Thus, when water is discharged via the mixing valve with the valve assembly in the neutral position as shown in FIG. 6, it first travels to port 33. It then enters valve passageway 222, and exits valve passageway 222 via port 35. Port 35 allows water to travel back to the wash tub, via a hose or conduit 35H (as shown in FIG. 9) without entering the mixing chamber. The water cannot go up the valve passageway 222 with the valve assembly in the neutral position because it is blocked by O-ring 47R above port 35, and it cannot enter the mixing chamber below, via port 34 because it is being blocked by O-ring 48R as shown in FIGS. 3 and 6.

While the valve assembly is in the neutral position, port 36 is open to the mixing chamber 130, but no material can escape past O-ring 46R located above port 36. Port 37 is connected via conduit or hose 37H back to hose 38H that leads directly to the wash tub for purposes of filling the tub.

Thus, when the valve assembly 340 is in the neutral position, the mixing chamber 130 is filled with the material contained in reservoir 134. The material is then trapped in mixing chamber 130 because port 34 and port 36 are blocked by O-rings 48R and 46R, respectively, above them. Water can enter through port 33 at this time if allowed by a supply means, such as the washing machine mixing valve, but cannot enter the mixing chamber 130, because an O-ring 48R is located between port 33 and port 34, thus blocking the path between these two ports. When water pressure is present while the plunger in this position, water travels to the washer via bypass port 35. This might be desired if, for example, a user turned off the automatic dispenser because the user decided not to add any agent contained within the reservoir; bypass port 35 allows the washing machine to fill with water by establishing a bypass route for the water to travel.

Figure 8:
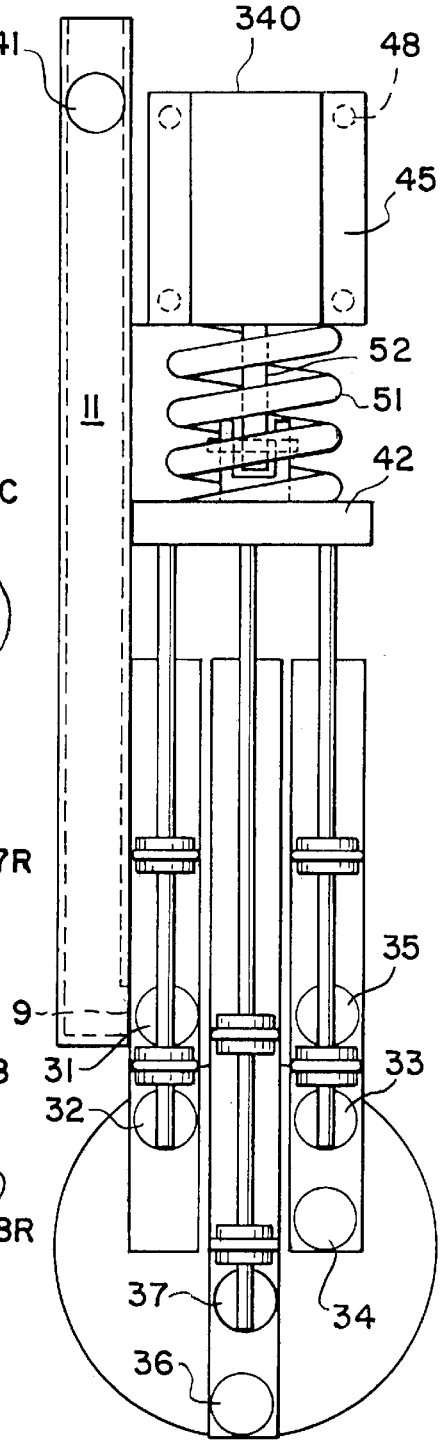
FIG. 8 is a front cut-away view of the same valve assembly shown in FIG. 6, but with the valve assembly in an activated state, or dispense position.

FIG. 8 shows the valve assembly with the solenoid charged and the valve plunger assembly 340 in an activated or dispense position. This position is achieved by upward movement of the solenoid arm 52, caused by a signal from the washing machine controls. The upward movement repositions the three fingers 42A, 42B, and 42C as shown in FIG. 8. When the plunger 42 is in this position, the path between port 31 and port 32 is blocked by O-ring 44R, preventing the contents of reservoir 134 from entering the mixing chamber 130. The O-ring 48R that was blocking the path from water supply port 33 to entrance port 34 of mixing chamber 130 is above port 33 when the valve assembly is in the activated position, and allows water pressure to enter into the mixing chamber via port 34. Water is also prevented from exiting out via bypass port 35 because the O-ring 48R is now between port 33 and port 35, blocking the path from port 33 to port 35. The path from port 36 to port 37 is open with the valve assembly in the activated position, and the water that enters the mixing chamber 130 combines with the detergent contained therein and flushes, or dispenses the contents out through port 36 into the valve passageway 220, and out port 37 to hose 37H and then to the wash basin via hose 38H. The washing machine mixing valve remains open long enough for all of the contents contained within the mixing chamber 130 to be completely flushed out and into the wash basin, and the mixing valve continues to remain open at least until the washing machine electronics signals the machine to stop filling when the water level in the wash tub has reached the proper level. At this point the water pressure is cut off by the washing machine mixing valve. The solenoid controlling the plunger 42 is then deactivated, preferably after a short delay period, and plunger 42 moves back it's original neutral position, urged there by spring tension supplied by spring 51. The device is now ready for the fill cycle to begin again.

In the preferred embodiment of the present invention the solenoid that operates the plunger assembly is directly wired to the electronics of the washing machine. The device of the present invention is wired so that when the machine instructs the mixing valve on the washing machine to open, after a delay of approximately 30 seconds a signal is sent to the solenoid of the mixing chamber 134 to open it; thus the water is diverted through the mixing chamber, flushing out the contents of the mixing chamber and dispensing it via port 36 and port 37, via hose 37H to hose 38H, which leads directly to the wash tub. The other dispensers (124 and 114) could also be activated at this time in the same manner as the detergent dispenser. Further, any of the dispensers could be wired to operate at different times. For example, fabric softener, which is ordinarily introduced during a rinse cycle, could be placed in dispenser 124, and the solenoid associated with dispenser 124 could be wired to activate when the mixing valve is opened during the rinse cycle. The present invention could also include a cutoff switch which would cause the signal being sent by the washing machine to be bypassed, which would allow the user to individually turn off any single dispenser, or all the dispensers, at any time. As noted above, a second time delay keeps the mixing chamber open for an additional period of time after the on/off mixing valve of the washing machine closes to allow the mixing chamber to drain completely.

In another embodiment of the present invention the dispenser solenoids could be user activated by switches, or the solenoids could be eliminated, and the plunger could be manually operated by means of a lever. In order for either of these embodiments to dispense, the user would first turn the machine on to start the fill cycle, and then the user could activate the switch or lever as the machine filled, so that the water pressure was available to flush the detergent, bleach, or fabric softener.

As noted above, the device of the present invention can be used with liquid or granular material. Although not necessary, it is also contemplated that a standard agitation means, such as a mechanical rotating screw or a vibration device, can be included within the reservoir to assist in urging the materials, particularly granular materials, towards the exit port.

The invention has not been described in all of its possible embodiments within the scope of this invention. While it is described for use in connection with a washing machine, it is not limited to washing machines and could be used for dispensing many different materials for many different reasons. To those skilled in the art, other embodiments would be apparent. Various changes, or modifications could be made, but would not depart from this invention.

What is claimed is:

1. A device for dispensing materials into a washing machine, said washing machine including a wash tub and including a wash water supply, said device comprising:

reservoir means for storing quantities of said materials to be dispensed and for dispensing said materials utilizing only the force of gravity, said reservoir means being of a size sufficient to hold enough of said materials for one or more washloads;

adjustable-volume mixing chamber means for containing a predetermined amount of said material dispensed from said reservoir means and for mixing said predetermined amount of said dispensed material with wash water; and routing means for routing materials from said reservoir means to said mixing chamber means and for routing wash water mixed with said materials from said mixing chamber means to the wash tub of said washing machine, said routing means comprising a solenoid actuated valve system and a plurality of valves and passageways, said solenoid actuated valve system controlling the flow of said wash water and said materials through said device by controlling the opening and closing of said plurality of valves.

2. A device as set forth in claim 1, wherein said routing means further comprises;

a first selectively openable and closable pathway connecting said reservoir means to said mixing chamber means;

a second selectively openable and closable pathway connecting said mixing chamber means to said wash water supply;

a third selectively openable and closable pathway connecting said mixing chamber means to said wash tub; and control means for controlling the opening and closing of said first, second, and third pathways so that said materials in said reservoir means can gravity feed into said mixing chamber means while the wash water supply is precluded from entering said mixing chamber means, and so that said wash water supply can enter said mixing chamber means and the contents of said mixing chamber means can enter said wash tub while said materials are precluded from entering said mixing chamber means.

3. A device as set forth in claim 2, wherein said control means includes a manually operated valve for opening and closing said first pathway.

4. A device as set forth in claim 2, wherein said control means comprises a solenoid operated valve system.

5. A device as set forth in claim 2, wherein said reservoir means comprises a plurality of reservoirs and said mixing chamber means comprises a plurality of mixing chambers, and wherein each reservoir is associated with a separate mixing chamber.

6. A device as set forth in claim 1, wherein said reservoir means comprises a plurality of reservoirs and said mixing chamber means comprises a plurality of mixing chambers, and wherein each reservoir is associated with a separate mixing chamber.

7. A device as set forth in claim 1, wherein said reservoir means includes agitation means for agitating said material stored in said reservoir means.

8. A device for dispensing materials into a container, said materials being mixed with a flushing fluid prior to being dispensed into said container, said device comprising:

reservoir means for storing quantities of said materials to be dispensed;

mixing chamber means for containing a predetermined amount of said material dispensed from said reservoir means and for mixing said predetermined amount of said dispensed material with said flushing fluid, said mixing chamber being adjustable in size to control the amount of said material contained therein; and routing means for routing materials from said reservoir means to said mixing chamber means and for routing said flushing fluid mixed with said materials from said mixing chamber means to said container.

9. A device as set forth in claim 8, wherein said routing means comprises a manually operated valve system.

10. A device as set forth in claim 8, wherein said routing means comprises a solenoid operated valve system.

* * * * *